United States Patent [19]

Kreft et al.

[11] 4,199,011

[45] Apr. 22, 1980

[54] SLEEVE FOR DRILL PIPES

[75] Inventors: Gunter Kreft, Melle; Helmut Husser, Damme, both of Fed. Rep. of Germany

[73] Assignee: H. Niemeyer GmbH, Fed. Rep. of Germany

[21] Appl. No.: 902,613

[22] Filed: May 3, 1978

[30] Foreign Application Priority Data

Mar. 20, 1978 [DE] Fed. Rep. of Germany ..... 2812181

[51] Int. Cl.[2] ..... F16L 57/00

[52] U.S. Cl. ..... 138/157; 138/158; 138/177

[58] Field of Search ..... 138/110, 159, 158, 157, 138/177; 308/4 A, 4 R

[56] References Cited

U.S. PATENT DOCUMENTS

| | | | |
|---|---|---|---|
| 3,164,216 | 1/1965 | Hall et al. | 308/4 A |
| 3,197,262 | 7/1965 | Fairchild | 308/4 A |
| 3,320,004 | 5/1967 | Garrett | 308/4 A |
| 4,042,023 | 8/1977 | Fox | 308/4 A |

*Primary Examiner*—Lenard A. Footland
*Attorney, Agent, or Firm*—J. C. Wray

[57] ABSTRACT

The invention provides a protective sleeve for drill pipes used for the drilling of deep wells in the ground for the recovery of oil, natural gas or similar, this protective sleeve being attachable in the connection area of the individual drill pipe rods and comprising a resilient inner part in the form of a ring part and a protective covering of a flexible and/or elastic material surrounding this inner part, characterized by this protective sleeve comprising two half shells with tension claws on the inside and spring segments on the outside adapted to be, joined together in a hinge-like fashion to form a closed ring.

10 Claims, 1 Drawing Figure

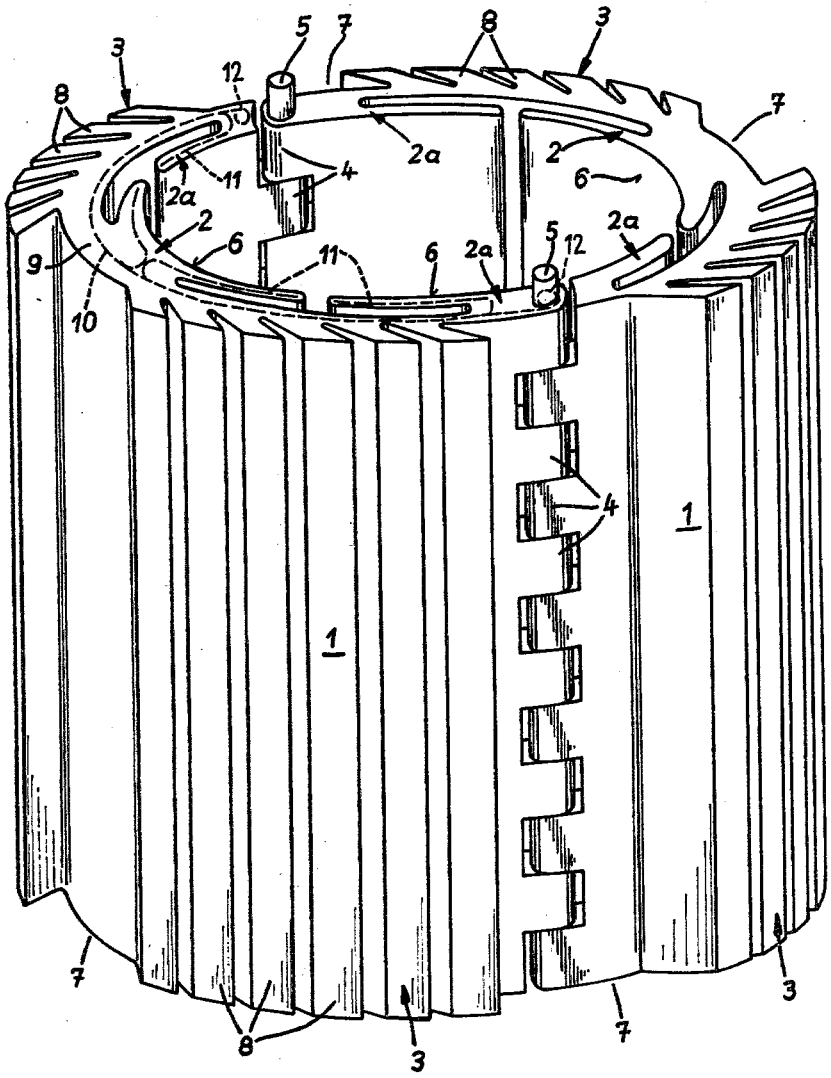
3
8
12
5
7
8
3
7
2a
2
6
4
11
2a
2
6
9
10
11
6
2a
5
12
2a
4
1
1
7
8
3
7
3

SLEEVE FOR DRILL PIPES

The invention relates to a protective sleeve for drill pipes used for the drilling of deep wells in the ground for the purpose of recovering oil, natural gas or similar, this protective sleeve being attachable in the connection area of the individual drilling pipe rods and consisting of an elastic inner part in form of part of a ring and a protective cover consisting of a flexible and/or elastic material surrounding this inner part.

BACKGROUND OF THE INVENTION

To protect the drill pipes, the drilling industry uses a rubber-like protective sleeve consisting of a ring-shaped spring-steel band as an inner part and a protective cover vulcanized onto this spring-steel band by means of a sanded vulcanizable material. The ring-shaped sleeve open at one place in the ring is then closed and locked into position by a wedge. When the wedge is driven in, the protective sleeve is frictionally clamped onto the drill pipes. In general, the drill pipes are provided with a protective sleeve at every 9 m of their length.

When drilling in rock and also within the casing pipe, the drill pipe rotates unevenly in the direction of rotation, and it would be subject to substantial wear without the protection offered by the sleeve. The protective sleeves known are only open on one side and have to be bent open initially with great effort by means of special pliers so that they can be placed around the drill pipe; subsequently, they are bent together again and clamped onto the drill pipe. The protective covering which is vulcanized on, is subject to substantial wear and furthermore opposes the motive power with a considerable frictional resistance.

OBJECT OF THE INVENTION

It is the object of the invention to improve a protective sleeve of the type mentioned above used on drill pipes by making it of simple design and manufacturable at a favourable cost, to provide an effort-saving, fast and very secure attachment on the drill pipes. It is also an object to provide a sleeve of high durability to guide the drill pipes in the well in a centering manner and at a saving of energy, and to provide a desirable flow of the flushing substance necessary for drilling.

SUMMARY OF THE INVENTION

According to the invention, this aim is achieved on a protective sleeve for drill pipes by the protective sleeve being formed by two half shells joined together via a hinge-type connection to form a closed ring, these half shells being provided with tension claws on the inside and spring segments on the outside.

Preferably, the two half shells are designed identically as regards their shape and size, being provided with teeth moulded onto their two longitudinal edges and meshing to form a compound tooth arrangement, so as to be releasably connected with each other by self-locking bolts inserted into the compound tooth arrangement.

Each half shell is provided on its inner side with at least one projecting tension claw of a T-like section; the tension claw has a convex-shaped contact surface for an operative connecting with the drill pipe, the radius of curvature of the contact surface being designed differently to and preferably smaller than the radius of curvature of the drill pipe.

On the outside of the two half shells, several spring segments are provided each leaving a flushing channel between each other, these spring segments consisting of several cross-pieces extending parallel to each other in the longitudinal direction of the shell and directed outwards in a sloping manner against the rotational direction of the drill pipe.

Preferably, each half shell consists of an elastic inner part in the form of a half shell consisting of steel plate, reinforcement means being provided thereon for each tension claw, and a protective covering of a flexible and/or elastic material, preferably a flushing medium resistant and chemical compound resistant plastic material, the reinforcement means being embedded in the material, whereby the protective covering with the molded-on tension claws and spring segments is designed in one part.

Further advantageous developments of the invention are obtained from the sub-claims; the subject of the invention does not only extend to the features of the individual claims but also to their combination.

As compared to the protective sleeves hitherto known, the protective sleeve according to the invention presents considerable advantages, i.e.:

The protective sleeve formed of two half shells connected with each other in a hinge-like manner has, on its inner surface, several tension-claw like projections whose channel-like contact surfaces are not identical with the radius of the drill pipe so that these projections are placed under tension when pressed against the drill pipe.

The protective sleeve consists of a reinforced spring plate insert sprayed with plastic so that even in the event of extended use there are no signs of fatigue in the plastic. The spring insert maintains the pretension and thus clamps the protective sleeve tightly against the drill pipe. Since the spring band insert extends right through from one joint of each half shell to the other, a slackening within the sheathing material that is plastic layer due to fatigue is impossible; this spring band insert keeps the half shells under permanent tension.

The plastic material used is resistant to the material forming the flushing medium and chemical compounds occurring in the earth. The plastic is elastic so that when the two half shells are closed, the tension claws designed to pretension frictionally press themselves around the drill pipe by being deformed in the contact surface owing to their radius of curvature differing from that of the pipe and thus being tensioned. This results in a very high clamping action and a tight fit. Even over extended periods, the protective sleeve maintains its axial and radial fit.

The outer diameter of the protective sleeve according to the invention is designed with several resilient spring segments which are separated by flow channels. These segments occupy an inclined position towards the direction of rotation and also consist of highly abrasion-proof elastic plastic. These springy segments have the purpose of protecting the drilling spindle as it rotates eccentrically from hitting the rock or the casing pipe. When hitting the rock or the casing pipe, the spring-like segments produce a rebuff effect which gives the drilling spindle a largely concentric centering.

In addition, this springy rebuff effect results in an extensive reduction of the frictional resistance so that the amount of energy required for the rotation of the drilling spindle is favourably reduced.

The longitudinal slots between the individual spring segments serving as flow channels also enhance the flow of the flushing agent, thus resulting in the elimination of considerable resistance. Thus considerably less energy is required for driving both the drilling pipe and the protective sleeve so that relatively small abrasion occurs due to the low friction of the sleeve on the outer walls and due to its high wear resistance.

Another effect presents itself due to the higher temperature resistance of the plastic used for the protective covering which does not change its structure at a temperature of at least 160° C.

The protective sleeve according to the invention is of simple design and can be manufactured at a favourable cost; it enables an energy-saving, fast and very secure attachment to be made to the drill pipe (in the screw connection area of the individual pipe rods) and is of permanent durability. Overall it should be said that when using the protective sleeve according to the invention, a considerable economic advantage is achieved, in particular as regards the small amount of energy required and the considerable safety advantages provided by the sleeve.

BRIEF DESCRIPTION OF THE DRAWING

An embodiment of the invention is now further described by means of the drawing, which is a perspective view of a protective sleeve for a drill pipe.

DESCRIPTION OF THE PREFERRED EMBODIMENT

The protective sleeve according to the invention for use on drill pipes is attached in the connection area of the individual drill pipe rods as a protection of their screw connection, and it is held against the drill pipe by means of clamping in the connection area.

The protective sleeve is formed by two half shells 1 connected with each other in a hinge-like fashion to form a closed ring, these half shells being provided on their inside with tension claws 2 pressing against the drill pipe and on their outside with spring segments 3 interacting with the borehole walls.

The two half shells 1 have a semi-cylindrical ring-like shape and are designed identically as regards their shape and size so that only one tool is required for the manufacture of both half shells and the half shells 1 are connectable turned by 180° around their longitudinal axis.

For the hinge-type connection of both half shells 1, each half shell 1 is provided with teeth 4 molded onto its two ends which project into the circumferential direction of the half shell and have grooves in between them. The half shells 1 are pushed into each other with their teeth 4 and thus form a compound tooth arrangement (groove-spring-connection). Two bolts 5 inserted into each compound tooth arrangement and extending into the longitudinal direction of the half shells keep the two half shells 1 together to form the closed ring, with the two bolts 5 extending beyond the length of the two half shells 1, being designed self-locking. The self-locking bolts 5 are driven into holes recessed in the teeth 4.

At least one molded-on tension claw 2 extends along the inner surface of each half shell 1, this tension claw 2 projecting beyond the inner surface of the half shell and being provided with a convex contact surface 6 whose radius of curvature—in relation to the radius of the drill pipe—is designed differently, preferably smaller, so that when the two half shells 1 are joined together, the tension claws 2 are pressed against the drill pipe and thus a tight clamping action between the protective sleeve and the drill pipe is achieved due to the deformation of the tension claws 2.

Preferably, each half shell 1 is provided on its longitudinal centre axis with a tension claw 2 and the two longitudinal edges of the shell with a section **2*a* of a tension claw, the tension claw sections 2*a* of the two half shells 1 producing, in the connected state of the half shells 1, a complete tension claw 2. The protective sleeve, in its preferred design, has four tension claws 2** which are evenly distributed over the inner circumference of the sleeve.

The one-part tension claws 2 have a T-like cross-section and the two-part tension claws **2*a* also result in a T-like cross-section which is caused by the angular cross-section of the tension claw sections 2*a*** following the joining together.

On the outside of each half shell 1, at least two spring segments 3 are provided in a projecting manner which between them form a flushing channel 7 extending in the longitudinal direction of the half shells.

Each spring segment 3 consists of several spring-sections 8 extending parallel at a distance to each other along the total length of the half shell 1, these spring sections 8 having for instance a rectangular cross-section. Preferably, the spring sections 8 of each spring segment 3 are arranged in an outward sloping manner against the rotational direction of the drill pipe, preferably directed tangentially, so that a favourable rebuff effect is achieved upon the rotational movement of the drill pipe with the protective sleeve and upon the spring segments 3 hitting against the borehole wall, this rebuff effect centering the protective sleeve and the drill pipe onto the borehole axis.

The protective sleeve is in toto provided with four spring segments 3, these spring segments 3 each forming a flushing channel 7 located on the longitudinal centre axis of the half shell within the compound tooth arrangement, this channel extending along the whole length of the half shell 1 and having a parallelogram-like cross-section with a larger parallelogram expansion extending in the circumferential direction of the protective sleeve.

The protective sleeve consists of an elastic inner part and a protective covering 9 surrounding the inner part and consisting of a flexible and/or elastic material, and both parts form one unit, whereby the inner part of each half shell 1 is formed by a half shell 10 of an elastic metal, preferably steel plate, situated between the tension claws 2 on the inside and the spring segments 3 on the outside. Each half shell 1 is provided—for each tension claw 2 and tension claw section **2*a* respectively—with a springy reinforcement means 11 in form of a channel-like metal strip, for instance, steel plate embedded in the tension claw 2 and in the tension claw section 2*a*** respectively.

The two half shell like inner parts 10 extend as a channel along the whole length of the half shells 1, and the reinforcement means 11 also extend along the whole tension claw length; at both longitudinal edges, each inner part 10 being formed into an eye which is situated in the area of the self-locking bolts 5 to receive the bolts 5 to lock the half shells together to form a closed ring.

The protective covering 9 consists of a flushing agent and chemical compound resistant resilient plastics material and is designed as a unit with tension claws 2 and the claw sections **2*a* respectively as well as the spring segments 3, and it accommodates the inner part 9**.

The size (diameter and length) of the protective sleeve can be designed according to the respective requirements. There is also the possibility of providing the tension claws 2 with a prism-like trapezoidal cross-section.

We claim:

1. A protective sleeve for drill pipes used for the drilling of deep wells in the ground for the recovery of oil, natural gas and other fuels, the sleeve being attachable in the connection area of the individual drill pipe rods and comprising:

(a) two half shells adapted to be releasably hinged together to form a closed ring, each shell having a springy inner part in the form of a ring part and a protective covering of a resilient material surrounding the inner part, (b) at least one tension claw formed on the internal surface of the inner part, each claw having a convex contact surface having a radius of curvature different from the radius of the drill pipes in order to provide a clamp connection between the protective sleeve and the rods, and (c) at least two resilient segments formed on the external surface of the protective covering to provide protection for the pipes during use.

2. A sleeve according to claim 1 in which the radius of curvature of the convex surface is smaller than that of the pipes.

3. A sleeve according to claim 1 in which the claws have a T-like cross-section and extend the whole length of the half shells.

4. A sleeve according to claim 1 in which each segment is directed outwards in a sloping fashion against the rotational direction of the drill pipe.

5. A sleeve according to claim 1 in which each segment is spaced longitudinally from an adjacent segment to form a flushing agent channel extending longitudinally of the half shells.

6. A sleeve according to claim 5 in which the sleeve has four segments.

7. A sleeve according to claim 1 in which a reinforcement shell of resilient material is embedded in each of the half shells, the reinforcement shell having resilient reinforcement means engaging the tension claws and having the form of channel-shaped strips of metal.

8. A sleeve according to claim 1 in which the inner part and the protective covering are made of a resilient plastics material resistant to washing agents and chemical compounds.

9. A sleeve according to claim 1 in which the half shells are identical in shape and size.

10. A sleeve according to claim 1 in which one of the tension claws is formed on the median longitudinal axis of each of the half shells and a tension claw part is in each case formed on the two longitudinal edges of each of the half shells, the claw part of one half shell forming with an adjacent claw part of another half shell a complete tension claw.

* * * * *